United States Patent [19]

Postlethwaite

[11] 3,973,674

[45] Aug. 10, 1976

[54] SHIPPING AND STORAGE PACKAGE FOR PAPER SHEET ITEMS

[75] Inventor: Carl A. Postlethwaite, Shawnee Mision, Kans.

[73] Assignee: Posty Cards, Incorporated, Kansas City, Mo.

[22] Filed: July 7, 1975

[21] Appl. No.: 593,706

[52] U.S. Cl. ..... 206/215; 206/73; 229/15; 229/87 R

[51] Int. Cl.[2] ..... B65D 65/00; B65D 85/00; B65D 1/34

[58] Field of Search ..... 206/215, 73, 214; 229/15, 27, 87 R, 29 R, 29 B

[56] References Cited

UNITED STATES PATENTS

| | | | |
|---|---|---|---|
| 2,478,635 | 8/1949 | Overly | 206/215 |
| 3,554,402 | 1/1971 | Lock | 229/27 |
| 3,563,449 | 2/1971 | Forbes, Jr. | 229/27 |
| 3,682,297 | 8/1972 | Austin et al. | 206/387 |

*Primary Examiner*—William Price
*Assistant Examiner*—Douglas B. Farrow
*Attorney, Agent, or Firm*—Schmidt, Johnson, Hovey & Williams

[57] ABSTRACT

A package for shipping and storing paper sheet items such as, for instance, greeting cards and the envelopes therefor, and which package is initially a flat sheet of cardboard material having a plurality of transverse lines of fold, the flat sheet being foldable along said lines to present a pocket for receiving said items and a cover therefor, the items being tightly retained in place in the package.

8 Claims, 3 Drawing Figures

SHIPPING AND STORAGE PACKAGE FOR PAPER SHEET ITEMS

It is the primary object of this invention to provide a package for shipping and storing paper sheet items such as, for instance, greeting cards and the normally associated envelopes for such cards, and whereby a given number of said items may be packaged in a compact fashion thus facilitating the handling thereof.

It is a further important object of this invention to provide a package for paper sheet items, which package initially takes the form of a flat sheet of cardboard material having a pair of spaced, longitudinal edges and a pair of spaced end edges, there being a plurality of transverse lines of fold extending between the longitudinal edges whereby to present a number of wall and panel portions, the initially flat sheet or blank being foldable along said lines whereby to present the finished package.

It is a yet further significant object of this invention to provide a package which, in its finished form, will tightly and securely retain therewithin a predetermined number of paper items, the package being variable in size, depending upon the number of such items to be packaged therewithin.

Yet another important feature is to present a package for greeting cards and the like wherein there is presented, in the front panel of the package, a window aperture whereby the contents of the package may be readily viewed by the recipient or user thereof, thus precluding the necessity of opening the package to ascertain the contents thereof.

Yet further objects include details of construction whereby the items within the package are tightly retained against both up and down and lateral movement by the walls and panels of the package, and also wherein the items are tightly retained within the package to preclude possible movement thereof and to also present, in overall form, as small a package as possible.

Yet another aim of the invention is to provide a package which is relatively inexpensive and which may be readily discarded after use, the package preferably being fabricated from a sheet of lightweight cardboard material which is initially formed into the blank with lines of fold thereacross and subsequently folded into the finished package.

Other objects of the invention will become apparent from the following specification and accompanying drawing, wherein.

Figure 1:
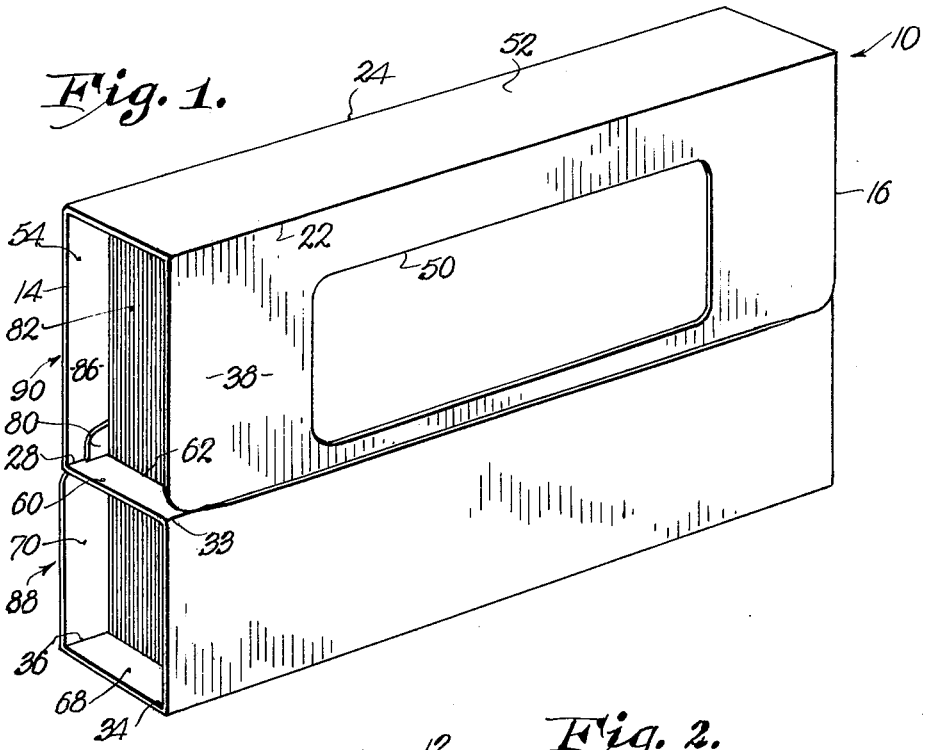
FIG. 1 is a perspective view of the finished package with the items therein.

The shipping and storing package for paper sheet items is broadly designated by the numeral 10 and assumes, in its finished configuration, a generally rectangular form although it will be appreciated that the specific configuration thereof might be altered to accommmodate the particular item being packaged therewithin. Likewise, the size of the package and, therefore, the number of items that it is capable of receiving can also be altered, it being intended however, that the package be designed to receive a predetermined number of items so that such items may be tightly retained within the package.

The package 10 is fabricated from an initially flat sheet of material 12, said sheet of material or blank 12 being fabricated from a cardboard material of desired thickness and usable for the purposes herein set forth.

The sheet of material or blank 12 has a pair of spaced, longitudinal edges 14 and 16, and a pair of spaced end edges 18 and 20 which circumscribe the blank 12.

The blank or sheet of material 12 is provided with a plurality of transversely extending lines of fold which span the distance between longitudinal edges 14 and 16. In viewing said lines of fold from left to right, in FIG. 2, there is presented a first line of fold 22, a second line of fold 24; a third line of fold which is divided into two segments 26 and 28; a fourth line of fold, likewise divided into two segments 30 and 32; a fifth line of fold 34 which extends completely across the sheet of material 12; and a sixth line of fold 36 which likewise extends completely across the sheet or blank 12.

The multiple lines of fold cooperate to define, both in blank form and in the finished form; the various walls and panels of the package 10. Thus, line of fold 22 cooperates with end edge 18 to define a front panel 38, said front panel 38 including a flap 40, said flap 40 being partially defined by a pair of opposed, inwardly extending slits 42 and 44, said slits respectively defining corresponding wings 46 and 48. Essentially centrally of front panel 38 there is provided a window aperture 50, generally rectangular in form although it will be appreciated that the aperture may assume any desired size or configuration.

The line of fold 22 and 24 cooperate to define therebetween a top panel 52 which spans the distance between longitudinal edges 14 and 16. Next, line of fold 24 and segments 26 and 28 cooperate to define a rear wall 54, which rear wall likewise spans the distance between longitudinal edges 14 and 16. The line of fold segments 26 and 30 define therebetween a strip 56 having an inner edge 58. Likewise, line of fold segments 28 and 32 define therebetween a strip 60 which has an inner edge 62 in opposed relationship to inner edge 58 of strip 56. Said inner edges, together with the adjacent edge of rear wall 54 and the adjacent edge of front wall 64, cooperate to define a generally rectangular opening 66, which opening extends transversely of the blank 12 and extends between inner edges 58 and 62.

The aforementioned front wall 64 is defined between line of fold segments 30 and 32 on one hand, and line of fold 34 on the other hand, said front wall 64 extending the full distance between longitudinal edges 12 and 14.

Next, lines of fold 34 and 36 cooperate to define a bottom panel 68, which panel 68 spans the distance between longitudinal edges 14 and 16. Lastly, the sheet of material 12 presents a rear panel 70 which is defined at one edge thereof by line of fold 36 and at the opposite edge by end edge 20 of the blank 12.

Rear panel 70 presents a generally rectangular portion having appended thereto a flap 72, the flap being partially defined by inwardly extending, opposed notches 74 and 76 which define, at the outermost end of the flap 72, corresponding tabs 78 and 80.

It will be readily appreciated that the blank 12 and the lines of fold and apertures, notches and slits which form a part thereof, can be readily fabricated from a generally rectangular sheet of cardboard material by conventional forming and cutting operation.

Figure 2:
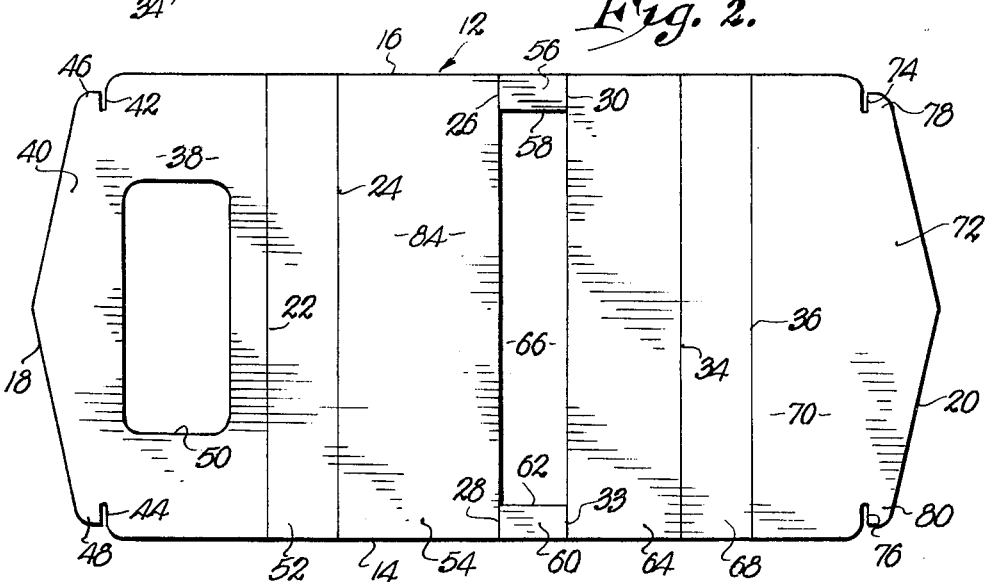
FIG. 2 is a plan view of the initially flat sheet of material which is utilized to form the package.
Figure 3:
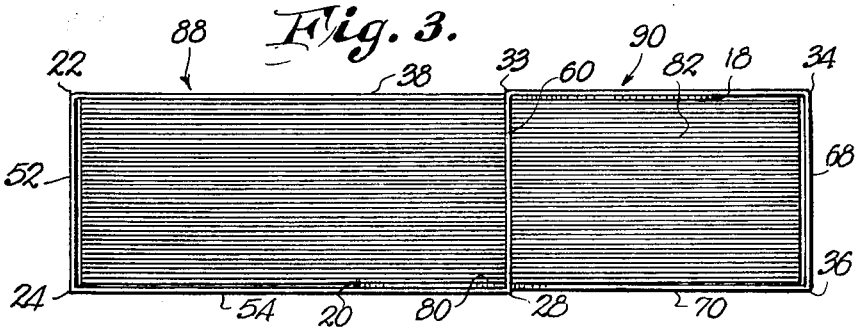
FIG. 3 is an end elevational view of one end of the finished package with the items therein.

When blank 12 is to be formed into the finished package 10 to receive items such as greeting cards 82 and/or associated envelopes therefor, or for that matter, any other sheet-like paper items, the blank 12, having previously had formed therein the hereinabove described lines of folds, apertures, slits and notches, is grasped with the first surface 84 thereof, which is the surface viewed in FIG. 2, facing upwardly, the second surface 86 thereof obviously extending downwardly.

To manually form the blank 12 into the finished carton 10, the blank is initially folded along line of fold segments 30 and 32 at the same time, thereby bringing front wall 64 into essentially perpendicular relationship with respect to the strips 56 and 60. The blank is then folded rearwardly along line of fold 34 to place bottom panel 68 in generally perpendicular relationship to front wall 64 and in parallel relationship to the strips 56 and 60. Then, the blank is folded upwardly along line of fold 36 to permit flap 72 to enter opening 66 in such a manner that the tabs 78 and 80 are brought into engagement with the second surface 86 of the strips 56 and 60. As this is done and panel 70 is urged in an upward direction, the angled inclination of end edge 20 will permit flap 72 of panel 70 to pass beyond the strips 56 and 60 to a point where the inner edges of said strips are received within corresponding notches 74 and 76, thus locking the rear panel 70 with respect to the strips 56 and 60.

When the foregoing has been accomplished, there is presented a pocket 88 for the package and which pocket presents upwardly facing opening 66, which opening is intended to receive therewithin the sheet items to be carried within the package 10. The package may remain in its partially formed condition until such time as the sheet items are placed therewithin. Then, it is appropriate and desirable to complete fabrication of the package by forming the cover 90 therefor, this being accomplished as follows.

Initially, rear wall 54 is swung upwardly to a generally vertical position along line of fold segments 26 and 28. Once in this position the blank is then folded along line of fold 24 whereby to place top panel 52 in essentially perpendicular relationship to the rear wall 54. The front panel 38 is then folded downwardly along line of fold 22 and into essentially aligned relationship with the front wall 64.

When the foregoing has been accomplished the flap 40 of front panel 38 may be moved into the pocket through opening 66. As this is accomplished, and due to the angularity of the edges of flap 40, the flap 40 will be received within the pocket until such time as the inner edges of strips 56 and 60 engage corresponding slits 42 and 44 and seat therewithin whereby to lock the front panel 38 with respect to the front wall 64 and, more particularly, the cover 90 of the package 10 with respect to the pocket 88 thereof.

When the package is completed as above described, it will be appreciated that the flap 72 of rear panel 70 is in overlying engagement to the inner surface of rear wall 54 whereby to add rigidity to the package, it being also noted that rear panel 70 is positioned at a point adjacent line of fold segments 26 and 28. Likewise, the front panel 38 is positioned with the flap 40 thereof in overlying relationship to the normally innermost surface of front wall 64, the slits 42 and 44 being engaged by strips 56 and 60 adjacent line of fold segments 30 and 32 respectively.

Thus, there is presented a package which is relatively rigid in its structure and which tightly receives therewithin the sheet items, lateral movement of the sheet items from the package through the otherwise open ends thereof being prevented by strips 56 and 60 which, as hereinabove described, span the opening 66. Likewise, top panel 52 and bottom panel 68 prevent up-and-down movement of the contents of the package whereby such contents are tightly retained. As will be appreciated, once the package has been folded to enclose its contents, the window aperture 50 permits the recipient or user of the package 10 to readily view the contents thereof without the necessity of opening the package.

However, when it is desired to open the package to gain access to the contents thereof, it is only necessary to lift upwardly on front panel 38 and thus disengage slits 42 and 44 from corresponding strips 56 and 60, thus permitting the entire cover portion to be swung rearwardly along line of fold segments 26 and 28 and, when this is accomplished, the contents can be readily removed from the pocket 88 of the package 10. The package may then be discarded or, if desired, fully unfolded to its initially flat condition and subsequently reused for packaging of similar items.

Having thus described the invention, what is claimed as new and desired to be secured by Letters Patent is:

1. A package for paper items comprising:

an initially flat sheet of material having a pair of spaced, longitudinal edges and a pair of spaced end edges;

a series of transverse lines of fold extending across said sheet between said longitudinal edges to define a front panel, a top panel, a rear wall, a front wall, a bottom panel, and a rear panel;

a pocket for receiving said items formed when said sheet is folded along certain of said lines of fold, said pocket being defined by said front wall, bottom panel and rear panel;

a cover for said items formed when said sheet is folded along certain other of said lines of fold, said cover being defined by said front panel, said top panel and said rear wall, said cover being engageable with said pocket whereby to retain said items in said package; and a pair of opposed, spaced-apart strips extending between said rear panel and said front wall, said strips having inner edges defining, with said rear panel and front wall, the open end of said pocket.

2. A package as set forth in claim 1, said front panel having a pair of opposed, inwardly extending slits formed therein at the opposite longitudinal edges thereof; a flap extending from said front panel and receivable within said pocket when the package is folded with said slits receiving the inner edges of corresponding strips adjacent said front wall, whereby to lock said cover in a closed condition.

3. A package as set forth in claim 2, said rear panel having a pair of opposed, inwardly extending notches formed therein at the opposite longitudinal edges thereof, said notches receiving the inner edges of corresponding strips when the package is folded whereby to space said rear panel from said front wall.

4. A package as set forth in claim 3, said strips spanning the ends of the pocket when the package is folded whereby to prevent lateral movement of the items in the pocket.

5. A package as set forth in claim 4, said rear panel having a flap thereon, extending beyond said notches, said flap and said rear wall being overlying when the cover is closed.

6. A package as set forth in claim 5, the flap of said front panel and said front wall being overlying when the cover is closed.

7. A package as set forth in claim 6, said front wall and front panel being spaced from said rear panel and rear wall respectively when the package is closed.

8. A package as set forth in claim 7, the distance of said spacing being equal to the substantially common length of said top panel, said strips and said bottom panel.

* * * * *